US005206682A

United States Patent [19]

Yamada et al.

[11] Patent Number: 5,206,682

[45] Date of Patent: Apr. 27, 1993

[54] IMAGE FORMING APPARATUS

[75] Inventors: Katsuhiro Yamada; Naoki Yamamura, both of Shizuoka, Japan

[73] Assignee: Tokyo Electric Co., Ltd., Tokyo, Japan

[21] Appl. No.: 926,155

[22] Filed: Aug. 5, 1992

[30] Foreign Application Priority Data

Aug. 13, 1991 [JP] Japan ..... 3-202688

[51] Int. Cl.[5] ..... G03G 15/00

[52] U.S. Cl. ..... 355/200; 355/210; 355/285

[58] Field of Search ..... 355/260, 200, 210, 282, 355/285, 202; 174/5 R; 361/331; 219/520, 538; 346/153.1

[56] References Cited

U.S. PATENT DOCUMENTS

| | | | |
|---|---|---|---|
| 4,891,678 | 1/1990 | Ishizu et al. | 355/285 |
| 4,899,182 | 2/1990 | Inoue | 346/153.1 |
| 5,049,940 | 9/1991 | Yamaguchi et al. | 355/260 |

FOREIGN PATENT DOCUMENTS

| | | | |
|---|---|---|---|
| 59-34315 | 8/1984 | Japan . | |
| 0224883 | 12/1984 | Japan | 355/285 |
| 0080882 | 8/1985 | Japan | 355/285 |
| 0176965 | 8/1986 | Japan | 355/285 |
| 63-64788 | 12/1988 | Japan . | |

*Primary Examiner*—A. T. Grimley
*Assistant Examiner*—Sandra L. Brasé
*Attorney, Agent, or Firm*—Frishauf, Holtz, Goodman & Woodward

[57] ABSTRACT

A laser printer includes a photoconductor unit and a developer unit which are removable from a housing of the printer. A fixing device having a heating roller and a cover covering the heating roller is arranged in the housing adjacent to the photoconductor unit. The cover includes an upper wall and a plurality of ribs formed on the outer surface of the upper wall to prevent an operator's hand from directly touching the outer surface of the cover. That rib which is closest to the photoconductor unit is formed to prevent the operator's fingers from being caught by the fixing-device-side end portion of the photoconductor unit.

14 Claims, 3 Drawing Sheets

IMAGE FORMING APPARATUS

BACKGROUND OF THE INVENTION

1. Field of the Invention

The present invention relates to an image forming apparatus, and more particularly, to an image forming apparatus provided with a heater type fixing device.

2. Description of the Related Art

Modern image forming apparatuses, such as laser printers, are provided with a removable photoconductor unit. The photoconductor unit comprises a photoconductive drum, and besides, a main charger and a cleaning device surrounding the drum. Further, the unit has finger lugs which are provided individually near two axially opposite end portions of the drum. An operator can take out the photoconductor unit from the housing of the printer by pulling it up with his fingers hooked to the lugs. Arranged beside the photoconductive drum are an optical system for exposing the outer circumferential surface of the drum on the basis of print data and a developing device for supplying the drum with a toner.

A toner image is formed on the photoconductive drum through a series of operations of the main charger, exposure system, and developing device. This toner image is transferred, by the agency of a transfer charger, to the surface of a paper sheet which is delivered from a paper feeder to the transfer charger. Thereafter, the paper sheet, having the toner image thereon, is delivered to a heater-type fixing device, whereupon the toner image is fixed on the sheet.

Since the fixing device is a heating element, it is generally located adjacent to the lower-course side of the photoconductor unit, with respect to the feeding direction of the paper sheet, across a ventilation space, lest the individual components of the unit be heated to an excessively high temperature. The temperature of each component of the photoconductor unit, especially the cleaning device which adjoins the fixing device, is prevented from excessively increasing by means of air in the ventilation space, which forms a heat insulating layer. Thus, waste toner particles in the cleaning device are prevented from solidifying.

The fixing device comprises a heating roller heated to a predetermined temperature by means of a tubed heater or the like, a pressure roller pressed against the heating roller, and a cover which conceals at least the heating roller to keep it at the predetermined temperature. The fixing device further comprises a maintenance member for cleaning the heating roller.

When the paper sheet, having the toner image thereon, is delivered along a paper transportation path to the heating roller and the pressure roller, it is transported between these rollers. As this is done, the toner image on the paper sheet is fixed thereon by heat and pressure from these rollers.

According to the laser printer constructed in this manner, the operator's fingers or hand sometimes may touch the cover of the fixing device during inspection of the interior of the printer, removal of jammed paper, etc. In such a case, the top face of the cover is heated to a high temperature of about 80° C. to 90° C. by the heating roller, so that the operator may possibly suffer a burn. This involves a problem on safety.

Formed between the fixing device and the photoconductor unit, moreover, is the ventilation space in which fingers can be inserted. In some cases, therefore, the operator may erroneously remove the unit from the housing with his hands on the end portions of the unit on the sides of the fixing device and the photoconductive drum, without holding the lugs for the purpose. If this is done, the photoconductor unit cannot be held stably, and the drum may possibly be damaged by being unexpectedly brought into contact with the developing device, housing, etc. In this case, moreover, the operator's fingers touch the drum on which a photoconductive layer is formed, so that the photoconductive layer will be soiled by fingerprints or the like. If the drum is damaged or soiled, it is difficult to obtain high-quality prints.

SUMMARY OF THE INVENTION

The present invention has been contrived in consideration of these circumstances, and its object is to provide an image forming apparatus in which an image carrier can be prevented from being soiled or damaged during operation for the removal of a photoconductor unit, and an operator's hand or fingers can be prevented from touching a high-temperature portion of a fixing device during maintenance operation or the like.

In order to achieve the above object, an image forming apparatus according to the present invention comprises a housing, a photoconductor unit removably arranged in the housing and having an image carrier, and a fixing device arranged adjacent to the photoconductor unit in the housing. The fixing device includes a heating member, a cover concealing the heating member, and a plurality of projections formed on the outer surface of the cover, for preventing an operator's hand from directly touching the outer surface of the cover and preventing the operator's fingers from being caught by that end portion of the photoconductor which is located on the fixing-device-side.

According to the image forming apparatus constructed in this manner, the operator's hand or fingers are prevented from directly touching the outer surface of the cover of the fixing device by the projections on the cover during inspection and maintenance of the interior of the apparatus, removal of jammed paper, etc. In this arrangement, each projection protrudes from the outer surface of the cover, and the temperature of its projecting end is much lower, e.g., by about 30° C., than that of the outer surface of the cover. Thus, there is no possibility of the operator's hand or fingers getting burnt if they touch the projections, that is, the safety of operation is improved.

In removing the photoconductor unit from the housing, moreover, the operator is prevented from holding the fixing-device-side end portion of the unit by the projections on the outer surface of the cover. Accordingly, the operator can hold neither of the end portions of the photoconductor unit on the sides of the fixing device and the image carrier as he takes out the unit. Thus, the operator cannot take out the photoconductor unit unless he holds regular grip portions of the unit, that is, lugs which are arranged individually near two axially opposite end portions of the image carrier. In consequence, the image carrier can be prevented from being damaged or soiled by fingerprints or the like, during the removal of the photoconductor unit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention, FIGS. 1 to 4 show a laser printer according to an embodiment of the present invention, in which:

FIG. 1 is a perspective view showing the printer and a process unit extracted therefrom;

FIG. 2 is a side view, partially in section, schematically showing the interior of the printer with the process unit therein;

FIG. 3 is an exploded perspective view of the process unit; and

FIG. 4 is a perspective view showing a cover of a fixing device.

DETAILED DESCRIPTION OF THE PREFERRED EMBODIMENT

An embodiment of the present invention applied to a laser printer will now be described in detail with reference to the accompanying drawings.

Figure 1:
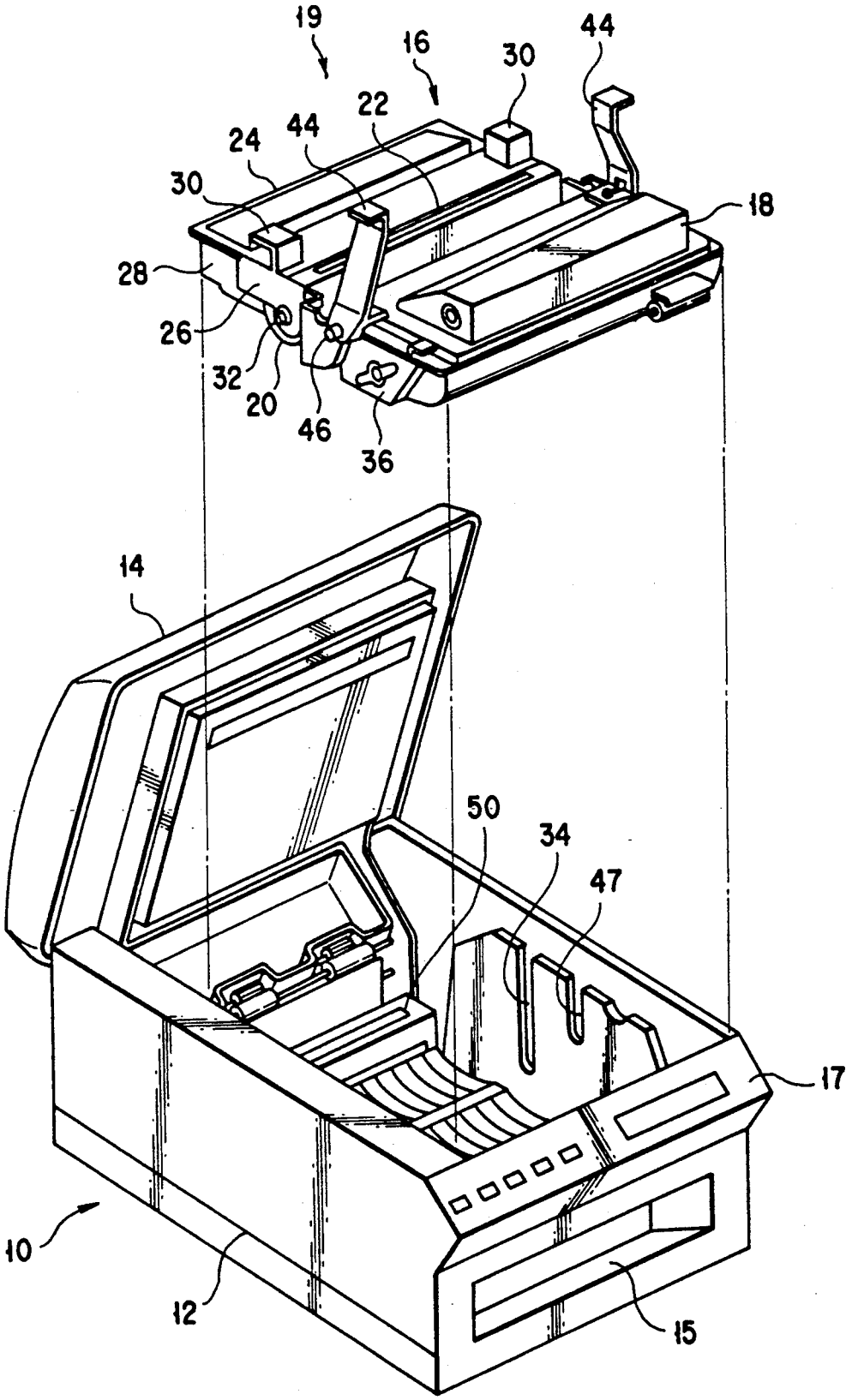

As shown in FIG. 1, the laser printer according to this embodiment comprises a housing 10, which includes a body 12 and a swingable upper case 14 for closing a top opening of the body. A paper inlet slot 15 is formed in a front end wall of the body 12, and a paper cassette (not shown) can be loaded into the slot 15. An operation section 17 is located over the slot 15. A process unit 19 including a photoconductor unit 16 and a developer unit (developing device) 18 is arranged in the body 12 so as to be removable through the top opening of the body. Also, an exposure unit (not shown) is disposed in the upper case 14.

Figure 2:
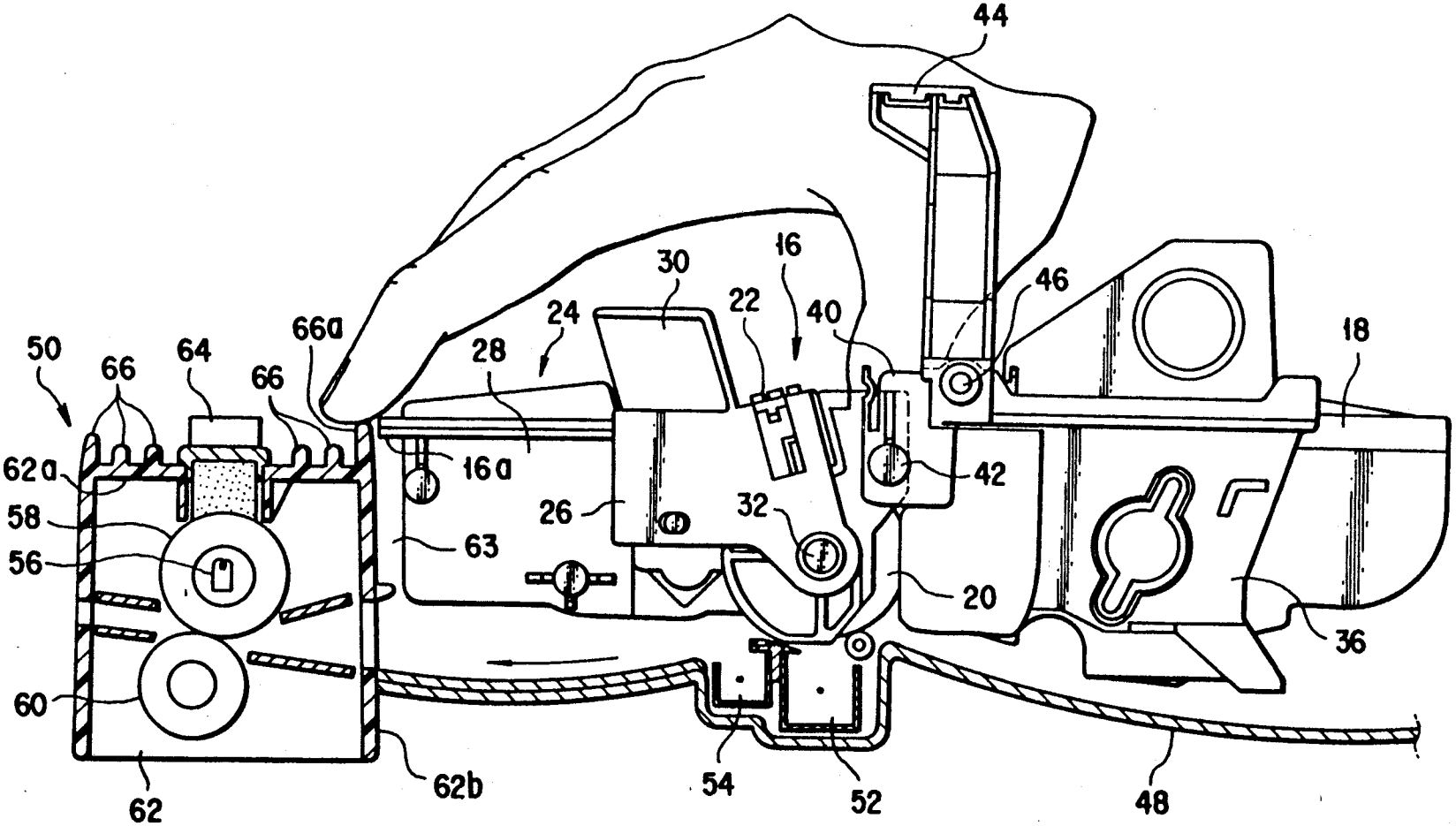
Figure 3:
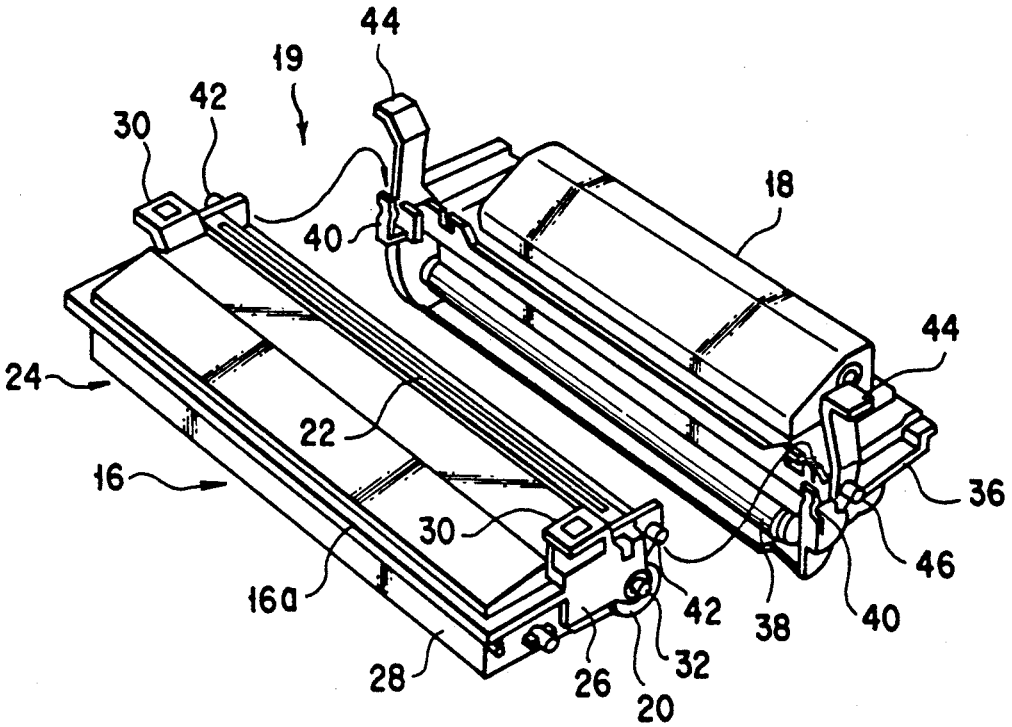

As shown in FIGS. 1 to 3, the photoconductor unit 16 includes a photoconductive drum 20 for use as an image carrier, a main charger 22 overlying the drum, and a cleaning device 24 situated at the back or on the left (as in FIG. 2) of the drum, these elements being arranged in a unit casing 26. The cleaning device 24 includes a blade (not shown), which engages the outer circumferential surface of the drum 20, and a waste toner case 28 for receiving waste toner particles scraped from the surface of the drum by means of the blade.

A pair of lugs 30 protrude from the top face of the casing 26, and are situated individually near opposite end portions of the photoconductive drum 20. An operator can take out the photoconductor unit 16 from the housing 10 by pulling it up with his hands on the lugs 30. Opposite end portions of a rotating shaft 32 of the drum 20 individually project sideways from the casing 26, and are slidably fitted in their corresponding guide grooves 34, which are formed individually in the respective inner surfaces of side walls of the housing body 12.

The developer unit 18 includes a casing 36, which has a toner storing section (not shown), and a developing roller 38 located in the casing and facing the photoconductive drum 20. A pair of hooks 40 are arranged at that end portion of the casing 36 which adjoins the photoconductor unit 16, and are situated individually near axially opposite end portions of the roller 38. A pair of engaging pins 42, which protrude individually from opposite side faces of the front end portion of the unit casing 26 of the unit 16, are removably in engagement with the corresponding hooks 40. Thus, the photoconductor unit 16 is removably connected to the developer unit 18.

The developer unit 18 further includes a pair of handles 44 which protrude upward from two opposite end portions of the top end of the casing 36, individually. A guide pin 46 protrudes from the proximal end portion of each handle 44. The pin 46 is slidably fitted in a guide groove 47 which is formed in the inner surface of each side wall of the housing body 12. The operator can take out the developer unit 18, along with the photoconductor unit 16, from the housing 10 by pulling it up with his hands on the handles 44. Since the photoconductor unit 16 is removably connected to the developer unit 18, it can be independently removed from the housing 10.

A paper guide 48, which underlies the process unit 19, extends from the paper inlet slot 15 to a heater-type fixing device 50, which will be described below. The guide 48 is fitted with a transfer charger 52 and a separation charger 54, which face the photoconductive drum 20.

Figure 4:
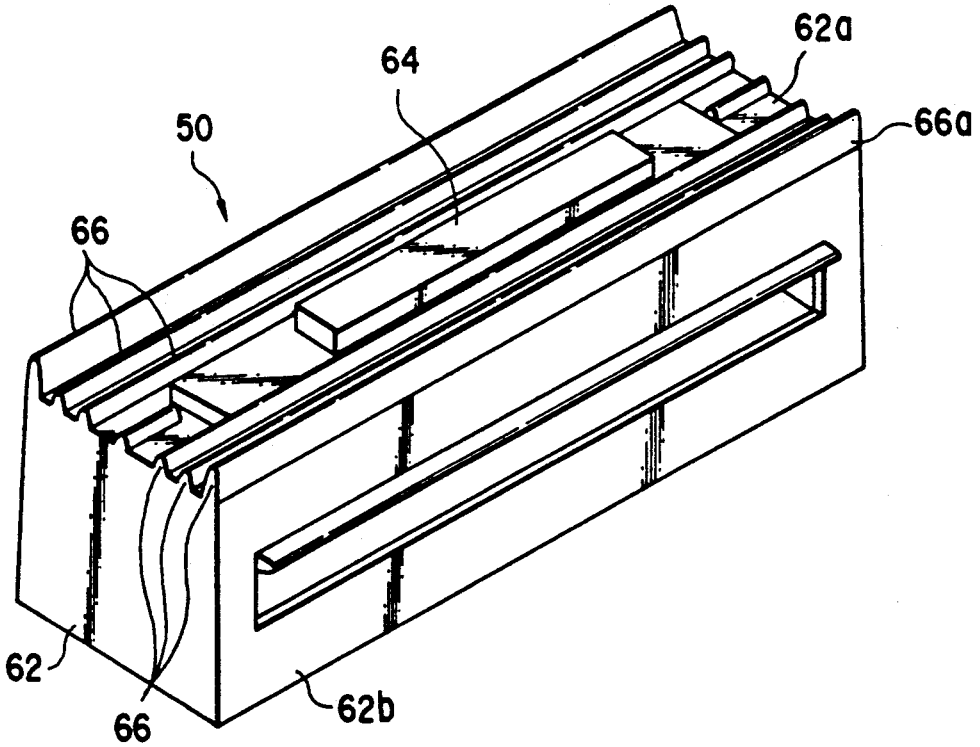

The fixing device 50 is provided at the rear end of the paper guide 48 so as to be situated at the back of the photoconductor unit 16, that is, adjacent to the waste toner case 28. As shown in FIGS. 1, 2 and 4, the fixing device 50 includes a heating roller 58 heated to a predetermined temperature by means of a tubed heater 56, a pressure roller 60 pressed against the heating roller, and a cover 62 which conceals these rollers to keep the heating roller at the predetermined temperature. The rollers 58 and 60 extend substantially parallel to the photoconductive drum 20. The cover 62, which is formed of resin, has the shape of an open-bottomed rectangular box. A top wall **62*a* of the cover 62 extends substantially horizontally, and is situated on a level a little lower than that of the top face of the photoconductor unit 16. A side wall 62*b* of the cover 62 on the photoconductor unit side faces the rear end portion (side face portion) of the photoconductor unit 16 across a ventilation space 63. Air in the space 63, which forms a heat insulating layer, prevents the individual components of the unit 16, especially the waste toner case 28, from being overheated by heat from the fixing device 50**.

A maintenance member 64 is removably attached to the top wall **62*a* of the cover 62, and extends along the axial direction of the heating roller 58. The member 64, which is in sliding contact with the outer circumferential surface of the roller 58, is used to clean this roller surface. A plurality of ribs 66, e.g., six in number, protrude from the outer surface of the top wall 62*a* of the cover 62, and extend along the axial direction of the heating roller 58 and throughout the length of the top wall. These ribs 66 are formed integrally with the resin cover 62**.

The ribs 66, which are arranged at intervals such that the operator's fingers cannot be inserted between them, prevent the operator's fingers or hand from directly touching the outer surface of the top wall **62*a* of the cover 62. That rib 66*a* which is situated nearer to the photoconductor unit 16 than any other ribs (first projections) 66 is higher than the other ribs, and has a height of about 6 mm, for example. The rib 66*a*, which constitutes a regulating projection or a second projection of the present invention, extends close to a rear end edge 16a of the top portion of the photoconductor unit 16, which extends substantially parallel to the photoconductive drum 20, lest the edge 16a be able to be caught by the operator's fingers. In other words, the top face of the rib 66a is substantially flush with the rear end edge 16a of the top portion of the photoconductor unit 16, and faces the edge 16a across a gap in which the operator's fingers cannot be inserted. The top portion of the ventilation space 63 is substantially closed by the rib 66a. Alternatively, the rib 66a may be designed so as to extend upward beyond the rear end edge 16a of the top portion of the photoconductor unit 16**.

According to the laser printer constructed in this manner, an electrostatic latent image is formed on the photoconductive drum 20 through a series of operations of the main charger 22, and exposure unit (not shown), and the latent image is developed by the developer unit 18 to form a visible or toner image. This toner image is transferred to the surface of a paper sheet which is transported along the paper guide 48. After this transfer process, toner particles remaining on the drum 20 are removed by means of the cleaning device 24, and are collected in the waste toner case 28. The paper sheet, having the toner image thereon, is separated from the drum 20 by means of the separation charger 54, and is delivered along the guide 48 to the fixing device 50. As the paper sheet is transported between the heating roller 58 and the pressure roller 60, the toner image on the sheet is fixed thereon by heat and pressure from the rollers 58 and 60. Thereafter, the paper sheet is discharged to the outside of the housing 10.

In removing the developer unit 18 and the photoconductor unit 16 from the housing 10 for replacement or inspection, the operator can take them out together along the guide grooves 34 and 47 by pulling them up with his hands on the handles 44 of the developer unit. Also in mounting the developer unit 18 and the photoconductor unit 16 in the housing 10, the guide grooves 34 and 47 are used as guide means, and the handles 44 are held by the operator's hands. In removing or mounting the photoconductor unit 16 independently, the operator holds its lugs 30 with his hands.

Since the heating roller 58 of the fixing device 50 is heated to about 185° C., the temperature of the outer surface of the cover 62 becomes as high as about 80° C. to 90° C. The operator's hands or fingers may possibly get burnt, therefore, if they directly touch the outer surface, especially the top face, of the cover 62, during inspection of the interior of the housing 10 or replacement of the maintenance member 64 of the fixing device 50. According to the present embodiment, however, the ribs 66 on the upper surface of the top wall 62a of the cover 62 serve to prevent the operator's hands or fingers from directly touching the top face of the cover. Each rib 66 protrudes from the top wall 62a, and the temperature of its top end portion ranges from about 50° C. to 60° C., which is lower enough than that of the upper surface of the top wall. Accordingly, the operator's hands or fingers cannot be burnt if they directly touch the end portions of the ribs 66.

Thus, the internal inspection and maintenance of the housing 10, replacement of the maintenance member 64, etc. can be carried out safely.

The rib 66a of the fixing device 50, which is situated nearer to the photoconductor unit 16 than any other ribs, is designed so that the operator's fingers cannot be hooked to the rear end edge 16a of the top portion of the photoconductor unit 16. In removing the photoconductor unit 16 independently from the housing 10, therefore, the operator cannot hook his fingers to the rear end edge 16a, hindered by the rib 66a, as shown in FIG. 2. Thus, the operator cannot take out the photoconductor unit 16 without holding the regular grip portions of the photoconductor unit 16, that is, the lugs 30 at the axially opposite end portions of the drum 20. In consequence, the photoconductor unit 16 can always be kept stable when it is taken out, and the photoconductive drum 20 can be prevented from unexpectedly engaging the developing device 18, housing 10, etc. and being damaged thereby. Further, there is no possibility of the operator's fingers touching the outer circumferential surface of the drum 20 and fingerprints or the like soiling the drum surface, so that high-quality prints can be obtained.

Since the top opening of the ventilation space 63 is substantially closed by the rib 66a, paper dust and toner particles on the maintenance member 64 can be prevented by the rib 66a from falling onto the paper guide 48 through the space 63 when the member 64 is removed. Thus, the paper sheet transported on the guide 48 can be prevented from being soiled.

In the above embodiment, for example, the ribs which continuously extend throughout the length of the top face of the cover are used as the projections of the fixing device. Instead of using these ribs, however, a number of projections may be arranged at intervals in the axial direction of the heating roller such that the operator's fingers cannot be inserted between the projections.

The present invention may be also applied to an image forming apparatus of a type such that a developing device can simultaneously perform developing and cleaning operations. In this case, a photoconductor unit need not be provided with an independent cleaning device.

Accordingly, it is to be understood that the present invention is not limited to the embodiment described above, and that various changes and modifications may be effected therein by one skilled in the art without departing from the scope of the invention, such changes and modifications are intended to be covered by the appendant claims.

What is claimed is:

1. An image forming apparatus comprising:

a housing;

a photoconductor unit removably arranged in the housing and having an image carrying body; and a fixing device arranged adjacent to the photoconductor unit in the housing, the fixing device including a heating member, a cover concealing the heating member, and a plurality of projections formed on an outer surface of the cover, for preventing an operator's hand from directly touching the outer surface of the cover and preventing the operator's fingers from being caught by the fixing-device-side end portion of the photoconductor unit.

2. An apparatus according to claim 1, wherein said photoconductor unit includes a top portion having one end portion adjoining the image carrier and the other end portion adjoining the fixing device, said cover of the fixing device includes a side wall, facing the photoconductor unit across a gap with a predetermined width, and a top wall extending continuous with the side wall and situated on a level lower than that of the top portion of the photoconductor unit, and said plurality of projections include a regulating projection extending close to the other end portion of the top portion of the photoconductor unit from the top wall.

3. An apparatus according to claim 2, wherein said regulating projection extends from the top wall to a level substantially as high as the level of the top portion of the photoconductor unit, and faces the other end portion of the top portion across a gap which prevents insertion of a finger.

4. An apparatus according to claim 3, wherein said regulating projection includes a rib continuously extending along the other end portion of the top portion of the photoconductor unit.

5. An apparatus according to claim 2, wherein said plurality of projections are arranged substantially throughout the area of the top wall of the cover, at intervals which prevent insertion of a finger.

6. An apparatus according to claim 5, wherein said plurality of projections include a plurality of ribs extending in parallel to one another.

7. An apparatus according to claim 2, wherein said image carrier includes a photoconductive drum, and said photoconductor unit has a pair of lugs to be held in taking out the photoconductor unit from the housing, the lugs being located individually near two axially opposite end portions of the photoconductive drum.

8. An apparatus according to claim 1, wherein said image carrier includes a photoconductive drum, said photoconductor unit has an end edge extending substantially in parallel to the photoconductive drum and adjoining the fixing device, and said projections include ribs extending substantially in parallel to the end edge and facing one another across gaps which prevent insertion of a finger.

9. An apparatus according to claim 8, wherein said heating member includes a heating roller extending substantially in parallel to the photoconductive drum, said cover includes a top wall hanging over the heating roller, and said plurality of projections include a plurality of ribs formed on the top wall and extending substantially in parallel to the heating roller.

10. An apparatus according to claim 9, wherein said plurality of ribs are arranged substantially throughout the area of the top wall, at intervals which prevent a finger.

11. An image forming apparatus wherein an electrostatic latent image formed on an image carrier is developed to a visible image by developing means, said apparatus comprising:

a housing;

a process unit removably arranged in the housing, the process unit including a developing unit having the developing means, and a photoconductor unit having the image carrier and connected to the developing unit to be removable from the developing unit, the photoconductor unit including a unit casing having a side face portion with a predetermined height, and means provided on the unit casing, for taking out the photoconductor unit from the housing independently; and a fixing device arranged adjacent to the side face portion of the unit casing of the photoconductor unit in the housing, the fixing device including a heated fixing member, a cover concealing the fixing member, a first projection formed on an outer surface of the cover, and a second projection formed on the outer surface of the cover to face the side face portion of the unit casing of the photoconductor unit, for preventing access of an operator's finger to the side face of the unit casing.

12. An apparatus according to claim 11, wherein said second projection includes a rib extending along the side face portion of the unit casing.

13. An apparatus according to claim 12, wherein said photoconductor unit includes a cleaning device for cleaning the image carrier, a part of the cleaning device defining the side face portion of the unit casing.

14. An apparatus according to claim 12, wherein said first projection includes a plurality of ribs extending along the rib of the second projection.

* * * * *